US010781084B2

(12) United States Patent
Henkel et al.

(10) Patent No.: US 10,781,084 B2
(45) Date of Patent: Sep. 22, 2020

(54) SUPPORT FOR A CRANE

(71) Applicant: Liebherr-Werk Ehingen GmbH, Ehingen (DE)

(72) Inventors: Joachim Henkel, Holzguenz (DE); Holger Schilke, Ehingen (DE)

(73) Assignee: LIEBHERR-WERK EHINGEN GMBH, Ehingen (DE)

( * ) Notice: Subject to any disclaimer, the term of this patent is extended or adjusted under 35 U.S.C. 154(b) by 86 days.

(21) Appl. No.: 15/887,688

(22) Filed: Feb. 2, 2018

(65) Prior Publication Data

US 2018/0222730 A1 Aug. 9, 2018

(30) Foreign Application Priority Data

Feb. 7, 2017 (DE) ..... 10 2017 001 128

(51) Int. Cl.
*B66C 23/78* (2006.01)
*B66C 23/84* (2006.01)
*B66C 23/88* (2006.01)

(52) U.S. Cl.
CPC ..... *B66C 23/78* (2013.01); *B66C 23/84* (2013.01); *B66C 23/88* (2013.01)

(58) Field of Classification Search
CPC ..... B66C 23/78; B66C 23/84; B66C 23/88; B66C 23/90; B66C 5/00
See application file for complete search history.

(56) References Cited

U.S. PATENT DOCUMENTS

| | | | | |
|---|---|---|---|---|
| 3,393,810 | A * | 7/1968 | Craighead | B66C 23/36 212/175 |
| 4,723,667 | A * | 2/1988 | Zimmerman | B66C 23/78 212/302 |
| 6,773,033 | B1 * | 8/2004 | Fugel | B66C 23/78 280/763.1 |
| 8,160,786 | B2 | 4/2012 | Morath et al. | |
| 8,794,670 | B2 * | 8/2014 | Fuegel | B66C 23/80 280/763.1 |
| 2013/0146557 | A1 * | 6/2013 | Willim | B66C 23/78 212/278 |

FOREIGN PATENT DOCUMENTS

| | | | |
|---|---|---|---|
| DE | 102008006119 | B3 | 6/2009 |
| DE | 102008021627 | A1 | 11/2009 |
| EP | 2298689 | A2 | 3/2011 |

OTHER PUBLICATIONS

Espacenet.com, Machine Translation of DE 10 2008 006 119, retrieved Nov. 14, 2019 (Year: 2019).*

* cited by examiner

*Primary Examiner* — Sang K Kim
*Assistant Examiner* — Nathaniel L Adams
(74) *Attorney, Agent, or Firm* — McCoy Russell LLP

(57) ABSTRACT

The present disclosure relates to a support for a crane, in particular for a mobile crane, having at least two first support beams and two second support beams that are each arranged pairwise at mutually oppositely disposed sides of the support.

12 Claims, 1 Drawing Sheet

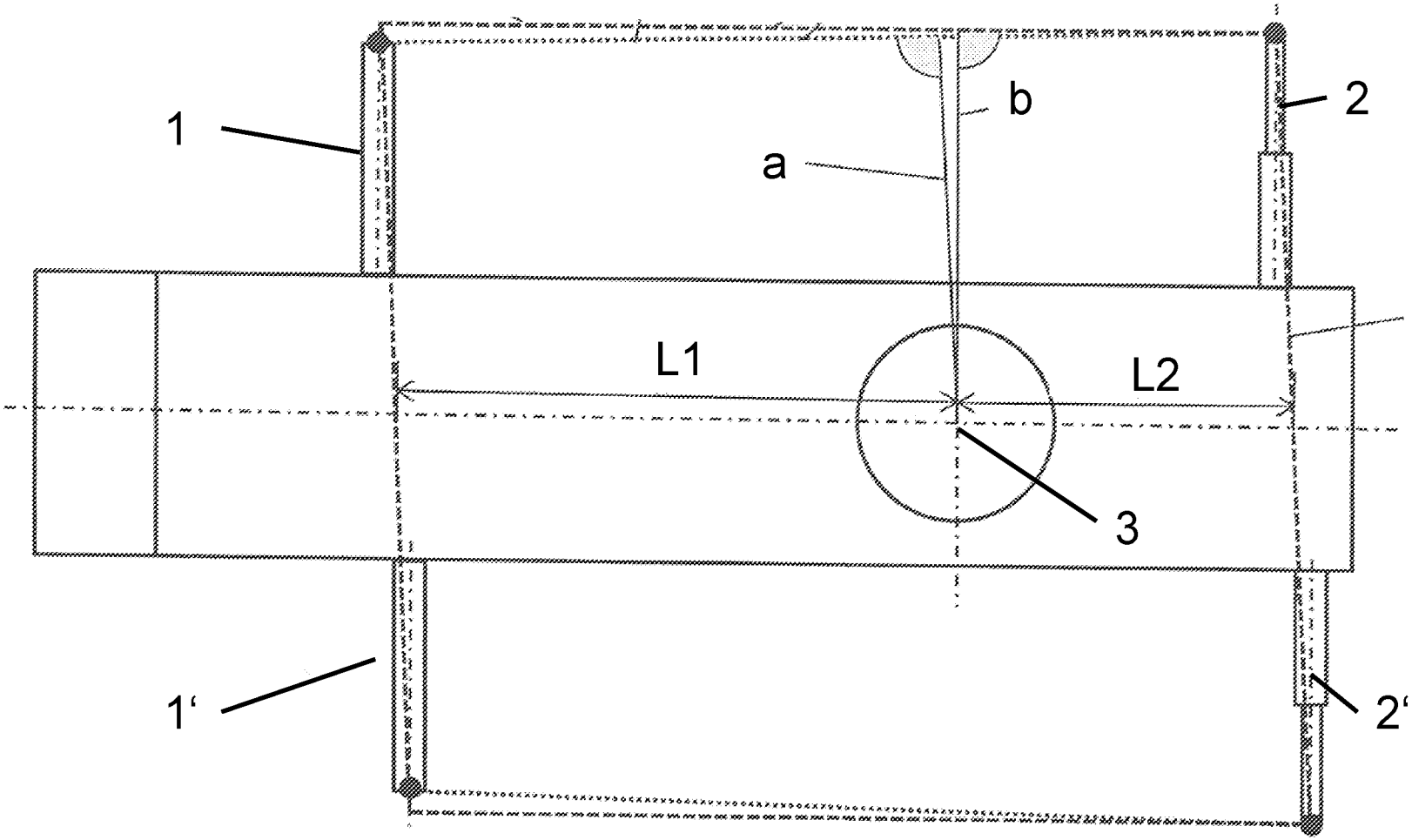
2
2'
L2
3
b
a
L1
1
1'

SUPPORT FOR A CRANE

CROSS REFERENCE TO RELATED APPLICATION

This application claims priority to German Patent Application No. 10 2017 001 128.1, entitled "Support for a Crane," filed Feb. 7, 2017, the entire contents of which is hereby incorporated by reference in its entirety for all purposes.

TECHNICAL FIELD

The present disclosure relates to a support for a crane, in particular for a mobile crane, having at least two first support beams and two second support beams that are each arranged pairwise at mutually oppositely disposed sides of the vehicle frame.

BACKGROUND AND SUMMARY

When configuring cranes or supports for cranes, an optimized ratio of tilt edges to one another inter alia plays an exceptional role. The spacing of the contact point of a slewing platform on an undercarriage of a corresponding crane from the individual tilt edges of the crane in a working position and in this respect from correspondingly extended or supported support beams is inter alia fixed in this process. The difference of the stabilities of the crane with respect to the individual tilting edges is minimized as much as possible here. This procedure depends on a plurality of constraints and is not simultaneously possible for all the tilt edges of the crane. As is known, at least two tilt edges can therefore be spaced apart by different amounts from the contact point of the slewing platform. All four tilt edges can also be spaced apart by different amounts. And they have to be coordinated with one another as required with respect to the stability.

If the spacing of the slewing platform contact point from one of the tilt edges is reduced here, the crane loses stability, and thus load bearing capacity overall, in the direction of the reduced spacing from the tilt edge. This has the result that the maximum permitted payload of the crane in a specific angular range that can be seen from the payload table is in some cases considerably below the actual maximum load that can be raised by the crane. Correspondingly calculated or prepared payload tables are as a rule stated for a 360° slewing range of the superstructure of a corresponding crane. These payload tables here typically show the minimal payload value of all observed tilt edges as the maximum permitted payload.

On a reduction of the payload in the direction of a tilt edge, this can under certain circumstances also effect a reduction of the maximum permitted payload in the direction of the total 360° slewing radius of the superstructure.

Against this background, it is the object of the present disclosure to further develop a support such that a permitted payload that is as large as possible is made possible in the whole 360° slewing radius range of the superstructure of a corresponding crane, while, at the same time, a design that is as light and as inexpensive as possible is achieved to form the support.

This object is achieved in accordance with the present disclosure by a support for a crane A support for a crane, in particular for a mobile crane, is accordingly provided having at least two first support beams and two second support beams that are each arranged pairwise at mutually oppositely disposed sides of the vehicle frame, with the maximum deployment range of the first support beams being smaller than the maximum deployment range of the second support beams.

The term support beams or deployable beams can relate in the present case to telescopic or pivotable support beams or to any other support beams adjustable relative to the remaining structure of the support. The term deployment range correspondingly designates the spacing an outermost section or a rest of a deployed support beam has from the support or from a reference point of the crane.

The term support can comprise any structures of a crane at which support beams that serve the support of the crane in a working position are indirectly or directly arranged.

The support beams are here, as is known, adapted to distribute loads resulting from the weight force of the crane, including any load lashed to the crane, to points that are as far away from one another as possible or are arranged as advantageously as possible with respect to one another for the stability of the crane.

On the utilization of a pair of first support beams that can be deployed less far than a pair of second support beams, the first support beams can be dimensioned as correspondingly smaller and thus lighter and less expensive. At the same time, it is made possible by the arrangement of the support beams in accordance with the present disclosure to ensure a spacing that is as large as possible between the center of rotation of the superstructure or the center of mass of a corresponding crane and the lateral tilt edges. Only a minimal loss of the relevant support width defined by the lateral tilt edges and thus of the stability toward the lateral tilt edge is thus achieved with respect to the supports known from the prior art and to the parallelogram-shaped support bases occurring therein.

It is conceivable in a preferred embodiment that the first support beams are support beams that can be telescoped n-fold and the second support beams are support beams that can be telescoped n+1-fold. The converse case is also conceivable in which the n-fold telescopic support beams correspond to the second support beams and have a smaller maximum deployment range than the first support beams. The case is also covered here that the first support beams are not telescopic at all, but rather foldable, for example. An embodiment is also conceivable in which at least some of the support beams are coupled to the remaining structure of the support in both a telescopic and pivotable or foldable manner.

Provision can, for example, be made in a simple case that the first support beams are support beams that can be telescoped once and the second support beams are support beams that can be telescoped twice and the variable "n" thus corresponds to the value 1. However, embodiments are also conceivable in which the second support beams are support beams that can be telescoped more than twice and the first support beams are, for example, support beams that can be telescoped exactly once or are support beams that cannot be telescoped at all, but that are rather foldable.

It is advantageous in a further preferred embodiment that the first support beams are arranged in a plane transverse to the longitudinal direction of the support or offset from one another. A further preferred embodiment can be configured such that the second support beams are arranged in a plane transverse to the longitudinal direction of the support or offset from one another. The planes in which the support beams can be arranged can in this respect be arranged perpendicular to the longitudinal direction of the support. The indications can furthermore relate to a state in which the support beams are extended to stabilize the crane and are in particular aligned perpendicular to the longitudinal direction of the support. With support beams arranged offset from one another, said support beams can in particular be offset from one another in the longitudinal direction of the support. They can here be offset by an amount or by a length that corresponds to their width or extent in the longitudinal direction. It is thus possible to arrange the support beams correspondingly arranged offset from one another in a manner correspondingly offset from one another in the further structure of the support and, for example, to utilize the total width or a large part of the width of the support for receiving or for providing the support beams. The offset arrangement of the support beams can furthermore relate to the arrangement of the coupling regions of the support beams by means of which the support beams are connected or coupled to the further structure of the support.

It is possible in a further preferred embodiment that the second support beams are arranged in a rear or front region of the support. The first support beams can here be correspondingly arranged in the respective other region of the support. The center of rotation of a superstructure that can be provided at the vehicle frame or the center of mass of the corresponding crane can furthermore be arranged in the rear region or in the front region of the support. A case is thus also described in which the center of rotation of a superstructure is located closer to the second support beams than to the first support beams. The center of rotation can thus be arranged closer to either the first support beams or to the second support beams.

It is furthermore advantageous in a further preferred embodiment that the tilt edge defined by the second support beams is arranged closer to the center of rotation of a superstructure of the crane than the tilt edge defined by the first support beams. The tilt edge here in particular relates to a state in which the support beams are at least partly extended to support the crane and can dissipate loads from the superstructure via the undercarriage of the crane into the ground. It is conceivable in a further preferred embodiment that the support is configured as an undercarriage or as part of an undercarriage of the crane or is composed of an undercarriage of the crane.

The present disclosure is furthermore directed to a crane, in particular to a mobile crane, having a support, with the support being configured as an undercarriage or as part of an undercarriage of the crane or being composed of an undercarriage of the crane. It is conceivable in a particularly preferred embodiment of the crane that the tilt edge defined by the second support beams of the support is arranged closer to a center of rotation of a superstructure of a crane than the tilt edge defined by the first support beams. The support can comprise further features or all the above-named features; an explicit repetition is dispensed with.

Further details and advantages of the present disclosure are explained with reference to the embodiment shown by way of example in the only FIGURE.

BRIEF DESCRIPTION OF THE FIGURE

FIG. 1 shows a schematic plan view of a support for a crane, in particular for a mobile crane, having a total of four support beams 1, 1', 2, 2' that are each arranged pairwise at mutually oppositely disposed sides.

DETAILED DESCRIPTION

The two first mutually oppositely disposed support beams 1, 1' here have a smaller maximum deployment range than the two second mutually oppositely disposed support beams 2, 2'. The maximum deployment range can here be defined as the maximum horizontal extent of the support beams 1, 1', 2, 2' perpendicular to the longitudinal axis of the support and away from the support. This extent is at a maximum when the support beams 1, 1', 2, 2' have been telescoped or pivoted outwardly. The longitudinal axis of the support is recognizable as the longest, transversely extending chain-dotted line.

The dashed and dotted lines show the extent of a parallelogram-shaped support base from the prior art (dashed) and of a trapezoidal or at least approximately trapezoidal support base in accordance with the present disclosure (dotted).

Lateral tilt edges of the support bases are shown at the top and bottom in FIG. 1 and front or rear tilt edges of the support bases that are associated with the respective support beams are shown at the left and right in FIG. 1. The spacing designated by the reference symbol a relates to the shortest spacing from a lateral tilt edge in the trapezoidal support base present in accordance with the present disclosure. The spacing designated by the reference symbol b corresponds to the shortest spacing from a lateral tilt edge in a parallelogram-shaped support base known from the prior art. Said spacings can be spacings between a center of rotation 3 of a superstructure of the crane and said tilt edges.

Reference symbols L1 and L2 designate spacings from the center of rotation 3 of the superstructure from the front tilt edge or from the rear tilt edge. As can be seen from FIG. 1, the spacing a is only minimally smaller than the spacing b and only a minimal loss of support width thereby occurs in accordance with the present disclosure.

The slewing platform contact point has the following properties: It is present as a construction feature and is fixed before a steel construction takes place, that is in the design phase. The position of the slewing platform on the undercarriage in the later configuration of the crane is fixed by it and it represents the center of rotation 3 of the superstructure in the product configuration or defines it.

The meaning of an optimized ratio of the tilt edges is as follows: On the evaluation of the stability of the crane, the tilt load utilization of the crane can be taken into account. All the masses of the crane are furthermore taken into account. The mass or the mass distribution is known via reliably estimated weights of the assemblies. The support width belongs to two support beams arranged pairwise and having support cylinders. It is the spacing of the support cylinders in the transverse direction toward the vehicle frame. Two tilt edges meet in the support cylinders. The slewing platform contact point has a spacing from every tilt edge. A balancing calculation of the stabilizing moments and of the tilt moments takes place to optimize the ratios of the tilt edges.

The advantage of the present disclosure comes into effect against this background. For although the support base (that is the size of the standing square) is reduced by the presence of only one support beam at one end of the crane, the stability only decreases by a negligible amount due to the design of the support in accordance with the present disclosure. The stabilities thus still remain balanced or coordinated with one another.

The above-mentioned spacing, that is the spacing of the slewing platform contact point from the tilt edges, can be varied, for example, by shortening the support beams, equally by displacing the slewing platform contact point.

Support bases can furthermore be imagined in which the support width at the side of the single sliding beams or of the first support beams 1, 1' is substantially less than at the side of the double sliding beams or of the second support beams 2, 2' or support bases in which the contact point is displaced more toward the single sliding beams 1, F.

Furthermore, in conjunction with payloads dependent on the angle of rotation, in particular in the 360° range of rotation of the superstructure, or in conjunction with maximum permitted payloads for the respective angular position of the superstructure, the loss of stability can be compensated in that the superstructure is rotated in the direction of the supports.

For the payload calculation takes place with payloads dependent on the angle of rotation with respect to the running time of the crane and takes account of the instantaneous spacing from the tilt edge and not the minimum of the range of rotation of 360°. This can compensate the disadvantage in stability, but requires a more exact planning of the use, in particular of the positioning, of the vehicle or crane.

To approximately reach the support widths of the double sliding beams or to keep the difference in support widths as small as possible, the single sliding beam solution means that the one sliding beam has to be slid out further than the two beams with the double sliding beam solution or that the clamping region—that is the part of the sliding beams that is in the sliding beam box—is considerably smaller with single sliding beams than with double sliding beams.

The loads or support forces in the clamping region of the support beams can thus increase considerably with the same undercarriage load capacity and the support region of both the single sliding beams and of the sliding beam box must be dimensioned greater than with double sliding beams of the same load capacity. Furthermore, the single sliding beam cannot be adapted as well to the load progression as is possible with double sliding beams (height, width, sheet metal thicknesses).

Despite the aforesaid unfavorable constraints, it is nevertheless possible to configure the combination of sliding beam box/single sliding beams as lighter and also more favorable with the same undercarriage load capacity, which makes up a further advantage of the present disclosure.

The first support beams 1, 1' arranged pairwise can be arranged at the rear or at the front at the undercarriage. The spacing L2 (spacing of the center of rotation 3 of the superstructure from the tilt edge of the second support beams 2, 2') is much smaller than the spacing L1 (spacing of the center of rotation 3 of the superstructure from the tilt edge of the first support beams 1, 1').

Due to this arrangement, the shortest spacing a from the lateral tilt edge is only negligibly smaller with a trapezoidal support base than the shortest spacing b from the lateral tilt edge with a parallelogram-shaped support base having four sliding beams that can be telescoped twice. Only a minimal loss of the relevant support width and thus of the stability toward the lateral tilt edge is thus achieved with respect to the parallelogram-shaped support base.

The present disclosure can comprise a combination of support beams arranged in pairs, being able to be telescoped twice, with support beams arranged in pairs and being able to be telescoped once. A support base can thereby be produced with maximally extended supports or support beams that is reminiscent of a trapezoid or that is a trapezoid.

This so-called trapezoidal support base is furthermore characterized in that the front and/or rear supports or support beams are in a plane transverse to the longitudinal direction of the support or can also be arranged offset from one another. The latter is shown in FIG. 1.

The invention claimed is:

1. A support for a crane, comprising:

at least two first support beams and two second support beams that are each arranged pairwise at mutually oppositely disposed sides of a vehicle frame, wherein a maximum deployment range of the first support beams is smaller than a maximum deployment range of the second support beams;

wherein the first support beams are n-fold telescopic support beams and the second support beams are at least (n+1) fold telescopic support beams, wherein n=1;

wherein the first support beams comprise single sliding beams and the second support beams comprise double sliding beams; and wherein the single sliding beams extend further than the double sliding beams.

2. The support in accordance with claim 1, wherein the crane is a mobile crane.

3. The support in accordance with claim 1, wherein the first support beams are arranged in a plane transverse to a longitudinal direction of the support or offset from one another.

4. The support in accordance with claim 1, wherein the second support beams are arranged in a plane transverse to a longitudinal direction of the support or offset from one another.

5. The support in accordance with claim 1, wherein the second support beams are arranged in a rear region or in a front region of the support.

6. The support in accordance with claim 1, wherein a tilt edge defined by the second support beams is arranged closer to a center of rotation of a superstructure of the crane than a tilt edge defined by the first support beams.

7. The support in accordance with claim 1, wherein the support is configured as an undercarriage or as part of an undercarriage of the crane or is composed of the undercarriage of the crane.

8. A crane, having a support, the support comprising at least two first support beams and two second support beams that are each arranged pairwise at mutually oppositely disposed sides of a vehicle frame, wherein a maximum deployment range of the first support beams is smaller than a maximum deployment range of the second support beams, wherein the support is configured as an undercarriage or as part of an undercarriage of the crane or is composed of the undercarriage of the crane;

wherein the first support beams are n-fold telescopic support beams and the second support beams are at least (n+1) fold telescopic support beams, wherein n=1;

wherein the first support beams comprise single sliding beams and the second support beams comprise double sliding beams; and wherein the single sliding beams extend further than the double sliding beams.

9. The crane in accordance with claim 8, wherein the crane is a mobile crane.

10. The crane in accordance with claim 8, wherein a tilt edge defined by the second support beams is arranged closer to a center of rotation of a superstructure of the crane than a tilt edge defined by the first support beams.

11. The support in accordance with claim 1, wherein either the first support beams or the second support beams are in a sliding beam box.

12. The support in accordance with claim 11, wherein at least one of the first support beams or the second support beams is detachable from the sliding beam box.

* * * * *